US007311064B2

(12) United States Patent
Schimmeyer

(10) Patent No.: US 7,311,064 B2
(45) Date of Patent: Dec. 25, 2007

(54) GAS WATER HEATER DAMPER/BAFFLE

(76) Inventor: Werner K. Schimmeyer, 8937 Acorn Pl., Santa Rosa, CA (US) 95409

( * ) Notice: Subject to any disclaimer, the term of this patent is extended or adjusted under 35 U.S.C. 154(b) by 270 days.

(21) Appl. No.: 11/130,747

(22) Filed: May 17, 2005

(65) Prior Publication Data

US 2006/0070618 A1 Apr. 6, 2006

Related U.S. Application Data

(63) Continuation-in-part of application No. 10/956,921, filed on Oct. 2, 2004, now Pat. No. 7,000,572.

(51) Int. Cl.
*F22B 7/18* (2006.01)

(52) U.S. Cl. ..... 122/155.2; 122/44.2; 122/160

(58) Field of Classification Search ..... 122/13.01, 122/18.1, 44.2, 155.2, 155.4, 160; 138/38
See application file for complete search history.

(56) References Cited

U.S. PATENT DOCUMENTS 3,009,475 A * 11/1961 Richterkessing et al. 137/512.1
4,269,166 A * 5/1981 Worley et al. ..... 126/285 R
4,372,485 A * 2/1983 McCabe ..... 236/1 G
4,770,160 A * 9/1988 Schimmeyer ..... 126/285 A
4,953,510 A * 9/1990 Akkala et al. ..... 122/13.01
5,239,947 A 8/1993 Schimmeyer
5,682,841 A 11/1997 Schimmeyer et al.
5,732,692 A 3/1998 Schimmeyer
5,787,846 A 8/1998 Schimmeyer
5,845,632 A 12/1998 Schimmeyer
6,302,063 B1 10/2001 Schimmeyer
6,546,897 B1 * 4/2003 Edds et al. ..... 122/44.2
6,584,940 B1 * 7/2003 Khadkikar et al. ..... 122/18.1
6,868,806 B1 * 3/2005 Schimmeyer ..... 122/155.1

* cited by examiner

*Primary Examiner*—Gregory Wilson
(74) *Attorney, Agent, or Firm*—Walter A. Hackler

(57) ABSTRACT

Apparatus for improving the efficiency of a water heater includes a combination damper assembly and heat transfer baffle. The damper assembly includes a plurality of movable damper with each damper leaning outwardly from one another when the dampers are in a closed position. The baffle depends from the damper assembly and includes a truncated conical shape in this position within the flue of a water heater for directing combustion gases from the burner against a flue wall.

14 Claims, 2 Drawing Sheets

GAS WATER HEATER DAMPER/BAFFLE

The present application is a continuation-in-part of U.S. Ser. No. 10/956,921 filed Oct. 2, 2004 now U.S. Pat. No. 7,000,572 and said application is incorporated herewith in its entirety herewith.

The present invention generally relates to apparatus for gas burning and/or oil burning water heaters and is more particularly adapted to apparatus for improving the efficiency of a gas burning and/or oil burning water heater, hereinafter commonly referred to as a gas water heater.

Typical fuel-burning water heaters include the combustion chamber disposed in a base of a water tank with a flue disposed within the tank for evacuation of the burner combustion gases therethrough and concomitant heating of water in the tank. The combustion gases exiting the water heater fluid typically pass through an exhaust flue for proper venting.

U.S. Pat. No. 5,682,842 to Schimmeyer describes a segmented heat deflector including cylindrical sections for enhancing heat transfer from the combustion gases through a flue wall and into surrounding water. This reference is to be incorporated herein in its entirety by this specific reference thereto in order to describe the benefits of the heat deflector and incorporate all the data presented therein.

The present invention provides apparatus for the enhancement of heat transfer from the combustion gases to the water and hot water heater through a flue with unexpected efficiencies due to a conically shaped baffle in combination with a damper.

A water heater damper is important in that energy losses through an exhaust flue can be significant; it is estimated that approximately 33% of the heat energy generated from the main burner and pilot light operation is lost directly up the flue.

In addition, an unrestricted duct allows cool room air to circulate freely through the hot water heater and its central core, thereby cooling the heated water and requiring the main burner to operate more frequently than would otherwise be necessary.

Thus, it is clearly desirable, for efficiency and cost considerations, to regulate the flow of gasses both in and out of a gas-fired hot water heater.

Numerous damping devices have been developed for use with boilers, furnaces, and other combustion gas-producing systems. Many are simply one-way mechanical valves that prevent outside air from coming down the exhaust duct.

While effective for that purpose, such devices often require significant exhaust flow in order to open, and thus are useable only with relatively large units, or those equipped with a fan or blower.

Some large commercial water heaters may include power-assisted or computer-controlled mechanical dampers. Unfortunately, such systems are too costly and cumbersome for widespread domestic use Useful and effective heat conserving systems for relatively small scale water heaters, for example domestic water heaters, have been described in U.S. Pat. No. 4,770,160, U.S. Pat. No. 5,239,947, U.S. Pat. No. 5,682,841, U.S. Pat. No. 5,732,692, and U.S. Pat. No. 5,845,632 to Schimmeyer, each of which is incorporated herein by this specific reference thereto.

For example, U.S. Pat. No. 4,770,160 discloses a vent damper which is incorporated into an exhaust flue above a water heater. The damper comprises a lightweight, frustroconical shaped floating poppet what is slidably mounted on a guide within a flue hood immediately above the heater.

When the heater burner is in operation, the hot exhaust gases lift the poppet allowing gas to escape around the poppet and into the flue. When the main burner is turned off, the poppet is lowered into a closed position where it rests atop the tank central passageway.

Unfortunately, while this system is effective in restricting the circulation of cool room air through the water heater, the long-term operation thereof may result in impaired movement of the poppet due to condensation and debris accumulating between the poppet and the central guide, thus inhibiting the free movement of the poppet along the guide.

Additionally because of the fragile, lightweight nature of the poppet, damage may occur thereto by handling of the device during installation, cleaning or maintenance thereof.

Although the floating poppet closure provides a substantial improvement over the prior art, the shape of the poppet tends to interrupt the vertical flow of exhaust gases, and deflects the flow away from a vertical direction. It can be appreciated that it is desirable to have a vent damper apparatus that directs a flow of exhaust gasses substantially vertically rather than deflecting the gasses, thus ensuring the hot gasses are passed into the exhaust port and not into a surrounding space.

U.S. Pat. No. 5,732,692 discloses a more complicated vent damper system that incorporates a floatable damper with an exhaust flue hood disposed above a water heater tank. A lightweight floating damper is movable along a faceted guide. This design tends to reduce the occurrence of condensation which could impede free movement of the damper.

Although these systems are effective, there remains a need for an efficient combination water heater damper/baffle.

SUMMARY OF THE INVENTION

Apparatus for proving the efficiency of a water heater having a tank, a burner, and a flue being disposed within the tank for evacuation of burnt combustion gases therethrough generally includes a base and a damper assembly.

The damper assembly extends from the base and limits flow of ambient air from the flue.

More specifically, the damper assembly includes a plurality of moveable dampers with each damper leaning outwardly from one another when the dampers are in a closed position. A frame is provided for supporting the dampers and enabling pivoting of the dampers from the closed position preventing ambient air flow therepast to an open position allowing passage of exhaust gases therepast. The dampers are generally disposed parallel to the exhaust gas flow in the open position.

An enhancing heat transfer baffle is provided and depends from the base with the baffle having a truncated conical shape and position within the flue for directing combustion gases from the burner against a flue wall.

More particularly, the damper assembly frame includes a lower cylindrical portion for fitting a water heater flue and an upper cylindrical portion with angulated sidewalls for supporting the dampers in the closed position. Preferably, the upper and lower portions are formed from a thermal ceramic and a metal liner may be disposed on an inside surface of the upper cylindrical portion.

Still more particularly, the damper assembly frame may include a pair of parallel pivot bars with each damper having an open ended angular bottom for pivotally engaging a respective pivot bar.

The frame further may include an upstanding center post for supporting a transverse arm extending through openings in each of the dampers to prevent upward movement of the dampers along the longitudinal axis of the apparatus.

More specifically, the upper cylindrical portion may include angulated sidewalls for supporting the dampers in a closed position. In that regard, each of the dampers may include edge retaining upstanding rims for enabling and insuring flush abutting contact with the angulated sidewalls.

Still more particularly, the baffle in accordance with the present invention may include a tapered tube and may be segmented with each segment being a tapered tube with adjacent tapered tubes having substantially equal diameters.

In an exemplary embodiment, the baffle includes three segments wherein the top segment and a middle have closed tops and wherein a bottom segment includes a divider disposed at a top of the bottom segment with the divider having an opening therein. All of this structure promotes heat transfer enhancing contact between the combustion gases and the water tank flue.

BRIEF DESCRIPTION OF THE DRAWINGS

The advantages and features of the present invention would be better understood by the following description when considered in conjunction with the accompanying drawings in which.

DETAILED DESCRIPTION

Figure 1:
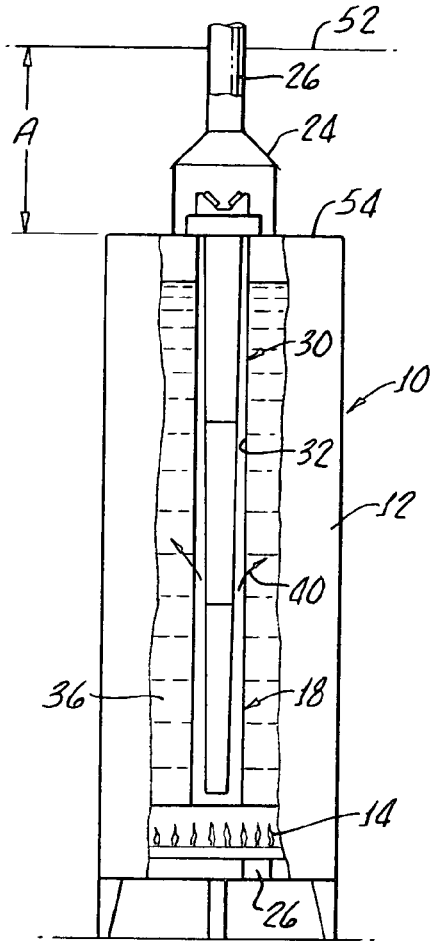
FIG. 1 is a plan view, partially broken away, of the present invention generally showing a hot water tank with a flue therethrough heated by a burner in combination with a damper assembly interconnected with a baffle for enhancing heat transfer through a flue wall.

With reference to FIG. 1, there is shown a hot water heater apparatus 10 in accordance with the present invention which generally includes a tank 12, a burner 14, disposed at a bottom portion 16 of the tank along with a flue 18, which provides a means for evacuation of burner gases therethrough to a vent damper 24 and thereafter to an exhaust flue 26.

It should be appreciated that the tank 12, burner 14, and flue 18 of the apparatus 10 may be of any conventional suitable design.

Figure 2:
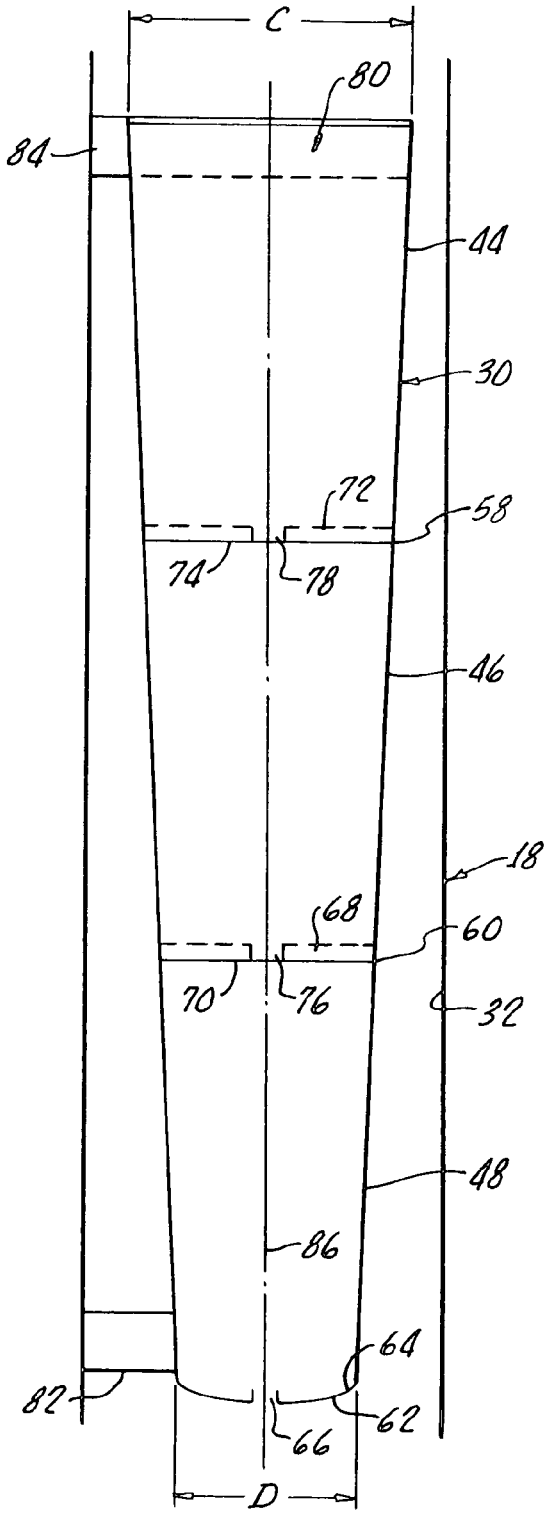
FIG. 2 is an enlarged plan view of the baffle shown in FIG. 1 positioned within the flue by tabs and including three segments of conically shaped tubes.

As shown in FIGS. 1 and 2, a baffle 30 is provided for enhancing heat transfer from combustion gases through a flue 32 and into surrounding water 36, as indicated by the arrows 40 in FIG. 1.

While the baffle 30 may be formed from a single piece of tubular material with a generally truncated conical shape for retrofit applications, the baffle in accordance with the present invention may generally include a top segment 44, a middle segment 46, and a bottom segment 48, as more clearly shown in FIG. 2. Preferably, the flue segments 44, 46, 48 are formed from polished stainless steel material in order to further reflect the heat into the flue wall 32.

With a clearance A between a ceiling 52 and a tank top 54, the segments 44, 46, 48 should preferably have a length each of less than about 15 inches. For a typical flue diameter B of about 4 inches, the top segment 44 has a maximum diameter C of about 2¼ inches and the bottom segment 48 has a minimum dimension D of about 1½ inches.

As shown in FIG. 2, it should be appreciated that adjacent tapered segments, or tubes, 44, 46 and 46, 48 have substantially equal diameters junctions 58, 60.

In order to effect proper heat deflection into the flue wall 32 while at the same time properly heating the baffle 32 to promote such heat transfer, the lower, or bottom, segment 42 includes a pan 62 disposed at a bottom 64 of the segment 48 with the pan 62 including an opening 66.

In addition, the middle segment 46 may include a pan, or closure, 68 disposed at a bottom 70 thereof and the top segment 44 includes a pan, or closure, 72 at a bottom 74 thereof, with the pans 68, 72 having holes 76, 78 therein. The top segment may include a cap 80. In order to center the baffle 30 within the flue 18, tabs 82, 84 disposed at 120° intervals around a centerline 86 on the bottom segment 48 and top segment 44 respectively, only two being shown in FIG. 2.

While similar in structure to the baffle shown in U.S. Pat. No. 5,787,846, the conical shape of the baffle 30 produces remarkable and unexpected efficiency when compared to the segmented cylindrical baffle described in U.S. Pat. No. 5,787,846, as hereinafter set forth in the hereinafter example.

EXAMPLE

In a 40 gallon gas fired water heater 10 with the baffle described in U.S. Pat. No. 5,682,841, the control setting was moved from a vacation setting to a normal hot water temperature after withdrawal of 5 gallons of hot water. The recovery time for the heater 10 to bring the water temperature to the set temperature was 5 minutes.

In a comparative test, the baffle described by U.S. Pat. No. 5,682,841 was removed in a baffle in accordance with the present invention installed into the water heater and the heater moved from a vacation to the same set temperature. The recovery time was 3 minutes and 30 seconds. This is about a 30% reduction in time or savings of 23% of gas usage, which is certainly unexpected in view of the shape difference between the two baffles.

Figure 3:
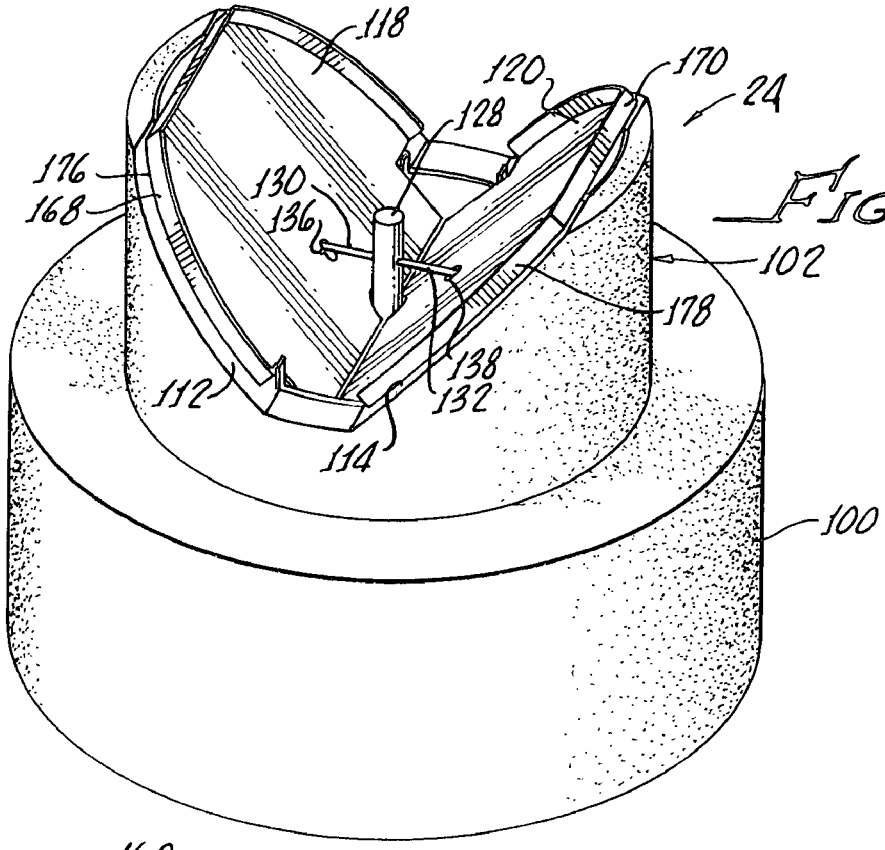
FIG. 3 is an enlarged perspective view of the damper shown in FIG. 1 generally showing a plurality of movable dampers with each damper leaning outwardly from one another when the dampers are in a closed position along with a frame for supporting the dampers and enabling pivoting of the dampers from the closed position as shown.
Figure 4:
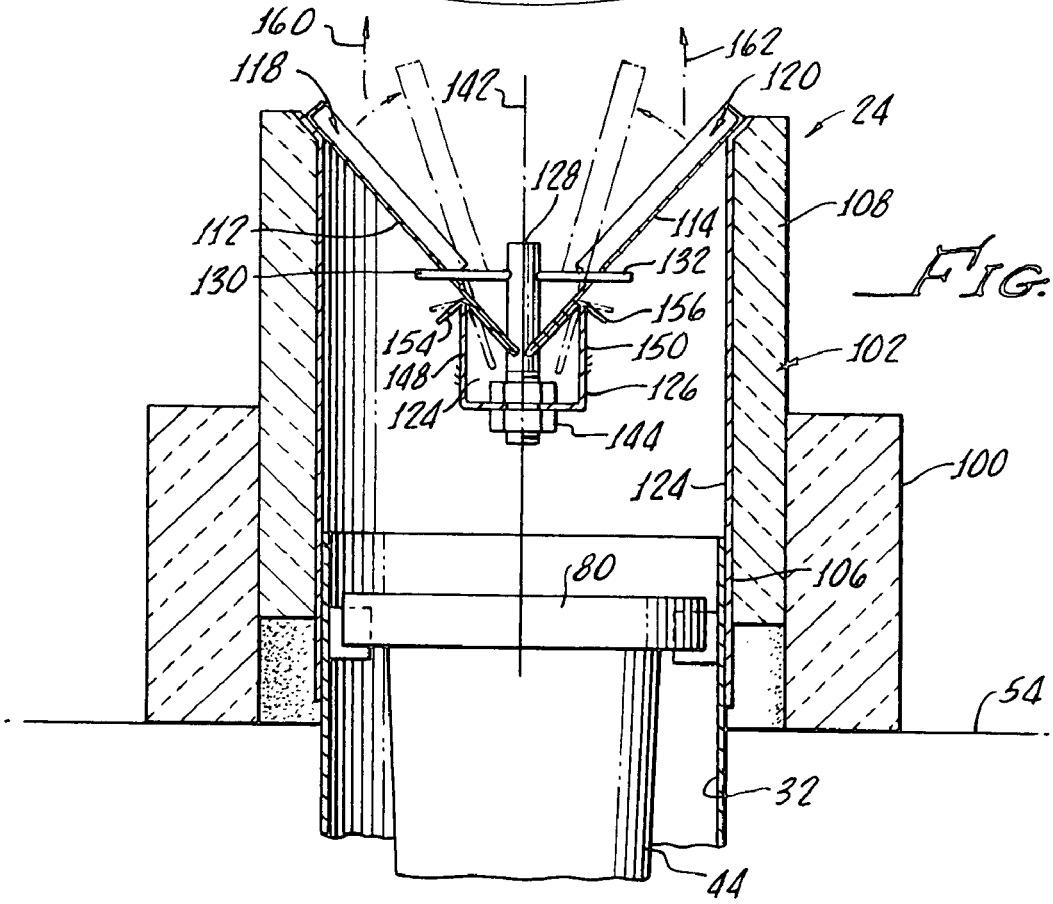
FIG. 4 is a cross sectional view of the damper assembly shown in FIG. 3 along with a base interconnecting the vent damper with the baffle and illustrating an open position of the dampers for exhaust of flue gases.

With reference to FIGS. 3 and 4, there is shown an enlarged view of the damper 24 in accordance with the present invention. A base 100 is provided and a damper assembly 102 extends from the base 100 for limiting full of ambient air from the flue 32.

A damper assembly 102 generally includes a frame 102 extending outwardly from the base 100 and affixed thereto by a suitable binder. Alternatively the base 100 and frame 102 may be formed from the single piece of material, preferably from the thermal ceramic such as, for example, Kaowool TBM®, this thermal insulating material improves efficiency on the damper by limiting heat loss by radiation from the damper assembly 102.

With particular reference to FIG. 4, the frame 102 includes a lower cylindrical portion 106 fitting the water heater flue 32 in an upper cylindrical portion 108 with angulated sidewalls 112, 114 for supporting dampers 118, 120 which lean outward from one another in a closed position, as shown in FIGS. 3 and solid line in FIG. 4. A metal lining 124 may be provided for facilitating assembly of the damper 24.

Fixed to the liner 124, preferably by welding, is a cross channel 126 which includes an upstanding post 128 which supports transverse arms 130, 132 extending through openings 136, 138 and the dampers 118, 120 in order to prevent upward movement of the dampers along a longitudinal axis 142.

The post 128 may be fixed to the cross channel by any conventional means such as, for example, a nut 144. A cross by in turn includes a pair of upstanding pivot bars 148, 150 and each damper 118, 120 includes open angulated bottoms 154, 156 for pivotally engaging a respective pivot bar 148, 150.

This pivotal arrangement enables pivoting of the dampers 118, 120 from the closed position shown in FIGS. 3 and 4 to an open position shown in dashed line in FIG. 4 to all passage of exhaust gases therepast, as indicated by the arrows 160, 162.

In the open position the dampers 118, 120 are in a generally parallel configuration while in a closed position the dampers 118, 120 lean outwardly from one another, as shown.

The dampers 118, 120 preferably made from a light weight material, such as aluminum or the like suitable in thickness and weight for being open by the flue gases 160, 162 to insure a secure abutting relationship between the dampers 118, 120 and sidewalls 112, 118, the dampers 118, 120 may include entertaining upstanding rims 170, which may be formed by bending of the damper edges 176, 178 or otherwise attached.

Although there has been hereinabove described a specific gas water heater damper in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. Apparatus for improving the efficiency of a water heater having a tank, a burner, and a flue being disposed within said tank for evacuation of burned combustion gases therethrough with resulting heating of water in said tank, said apparatus comprising:

a base; and a damper assembly, extending from the base and limiting flow of ambient air from the flue, the damper assembly including: a plurality of movable dampers, each damper leaning outwardly from one another when the dampers are in a closed position; and a frame for supporting the dampers and enabling pivoting of the dampers from the closed position preventing ambient air flow therepast to an open position allowing passage of exhaust gases therepast, said dampers being disposed generally parallel to exhaust gas flow in said open position; and an enhancing heat transfer baffle, depending from said base, the baffle having a truncated conical shape and positioned within the flue and directing combustion gases from the burner against a flue wall.

2. The apparatus according to claim 1 wherein said frame comprises a lower cylindrical portion fitting a water heater flue and an upper cylindrical portion with angulated sidewalls for supporting the dampers in the closed position.

3. The apparatus according to claim 2 wherein the upper and lower cylindrical portions are formed from a thermal ceramic.

4. The apparatus according to claim 3 wherein said frame further comprises a metal lining disposed on inside surfaces of the upper cylindrical portion.

5. The apparatus according to claim 2 wherein each damper includes edge retaining upstanding rims enabling fluid abutting contact with the angulated sidewalls.

6. The apparatus in accordance with claim 1 wherein said frame includes a pair of parallel pivot bars and each damper includes an open angulated bottom for pivotably engaging a respective pivot bar.

7. The apparatus according with claim 6 wherein said frame includes an upstanding center post for supporting a transverse arm extending through an opening in each damper to prevent upward movement of the dampers along a longitudinal axis of the apparatus.

8. The apparatus according to claim 1 wherein a baffle comprises a tapered tube.

9. The apparatus according to claim 1 wherein the baffle is segmented, each segment being a tapered tube, adjacent tapered tubes having substantially equal diameters.

10. The apparatus according to claim 9 wherein the baffle includes three segments.

11. The apparatus according to claim 10 wherein a top segment and a middle segment have closed tops.

12. The apparatus according to claim 11 wherein a bottom segment includes a divider disposed at a top of said bottom segment, said divider having an opening therein.

13. Apparatus for improving the efficiency of a water heater having a tank, a burner, and a flue being disposed within said tank for evacuation of burned combustion gases therethrough with resulting heating of water in said tank, said apparatus comprising:

a base; and a damper assembly, extending from the base and limiting flow of ambient air from the flue, the damper assembly including: a plurality of movable dampers, each damper leaning outwardly from one another when the dampers are in a closed position; and a frame for supporting the dampers and enabling pivoting of the dampers from the closed position preventing ambient air flow therepast to an open position allowing passage of exhaust gases therepast, said dampers being disposed generally parallel to exhaust gas flow in said open position, said frame comprising a lower cylindrical portion fitting a water heater flue and an upper cylindrical portion with angulated sidewalls for supporting the dampers in the closed position, the upper and lower cylindrical portions being formed from a thermal ceramic.

14. The apparatus according to claim 13 wherein said frame further comprises a metal lining disposed on inside surfaces of the upper cylindrical portion.

* * * * *